US006774295B2

(12) United States Patent
Tuite

(10) Patent No.: US 6,774,295 B2
(45) Date of Patent: Aug. 10, 2004

(54) MUSICOVERALLS

(76) Inventor: Patricia Anne Tuite, 205 Sparatist Rd., Storrs, CT (US) 06268

( * ) Notice: Subject to any disclaimer, the term of this patent is extended or adjusted under 35 U.S.C. 154(b) by 0 days.

(21) Appl. No.: 10/219,112

(22) Filed: Aug. 15, 2002

(65) Prior Publication Data

US 2003/0070535 A1 Apr. 17, 2003

Related U.S. Application Data

(60) Provisional application No. 60/314,551, filed on Aug. 24, 2001.

(51) Int. Cl.[7] ..... G10G 3/00
(52) U.S. Cl. ..... 84/453
(58) Field of Search ..... 84/453, 327, 329, 84/421, 280; 224/901.8

(56) References Cited

U.S. PATENT DOCUMENTS 3,596,754 A * 8/1971 Peterson, Jr. ..... 206/184
5,669,495 A * 9/1997 West ..... 206/317
5,816,395 A * 10/1998 Dougherty ..... 206/314

* cited by examiner

*Primary Examiner*—Kimberly Lockett

(57) ABSTRACT

A protective pad for use covering the vulnerable components of music sound equipment such as guitar or bass amplifiers, speakers, and public address systems. When the pad is attached, it is form-fitting to the front, covering the knobs, screens, or fabric which might otherwise be damaged when left exposed. The way in which the pad attaches to the music equipment allows it to remain attached even while the equipment is in use, which saves space and can provide a cushioned surface for further protection and use.

6 Claims, 3 Drawing Sheets

MUSICOVERALLS

CROSS-REFERENCE TO RELATED APPLICATIONS

This application claims the benefit of Provisinal Application 60/314,551 filed Aug. 24, 2001.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

I am a musician. As a musician, it is necessary to transport musical equipment to and from engagements. For years, the equipment has been nicked, dented, damaged, and pieces broken due to a lack of protective padding. Fabric has been snagged and torn, creating cosmetic damage, as well. I have tried blankets, tarps, and even plastic trash liners to protect equipment, but the use of these can be unwieldy at times and looks unprofessional. When I have requested a cover from manufacturers, many times they do not have one or the one that may exist is bulky and has no padding. In addition, musicians often have limited space in which to place their belongings while performing, which makes an amplifier "case" get in the way. Out of necessity, I created a unique form of protection for my equipment which is not bulky, is padded, and can be left attached to the top or bottom of the equipment while it is in use, making it useful as a protective cushion even when the equipment is in use.

BRIEF DESCRIPTION OF THE INVENTION

MusiCoveralls is the name of a protective pad for use covering the vulnerable surfaces and components of music sound equipment, such as guitar or bass amplifiers, speakers, and public address systems. When the pad is attached, it is form-fitting to the front, covering the knobs, screens, or fabric which might otherwise be damaged when left exposed. The size and material of the outside of the pad can be manufactured to adapt to the size of the musical equipment and the aesthetic desires of the consumer. Pockets can be added as well, for cords or other small items to store. MusiCoveralls saves space, provides protection from the damage that can occur while shifting and/or bumping into other equipment during transport, and does not need to be removed from the equipment when it is in use, which is a unique application of this invention.

DETAILED DESCRIPTION OF THE INVENTION

Figure 1:
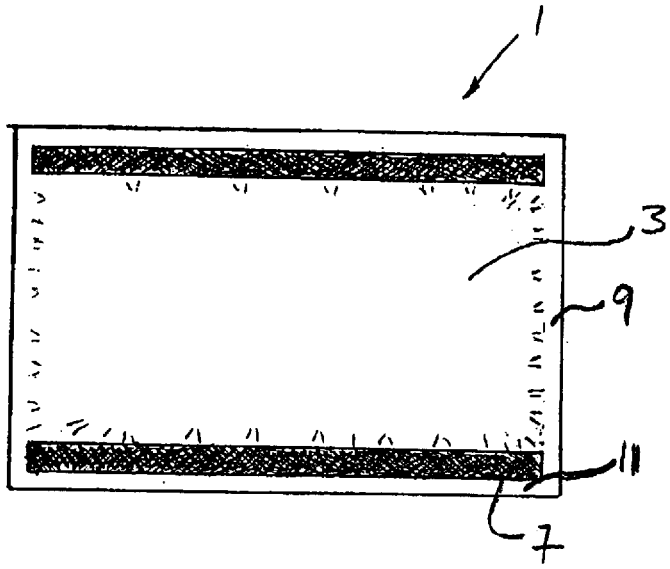
FIG. 1. A view from the back, showing the attachment of hook and loop strips to the top and bottom. The front view is identical with the exception that no strips are attached.
Figure 2:
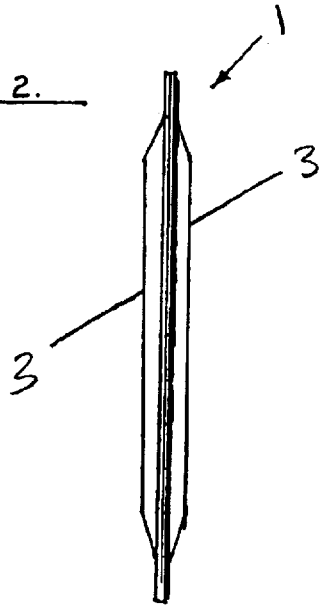
FIG. 2. A view from the side, showing the effect of the soft foam in the interior.
Figure 3:
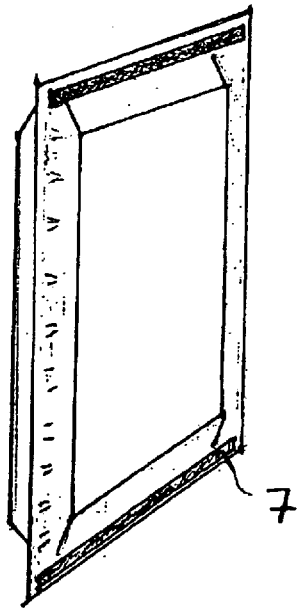
FIG. 3. A view of approximately 35 degrees, which shows a slight view of the front, and most of the back view.
Figure 4:
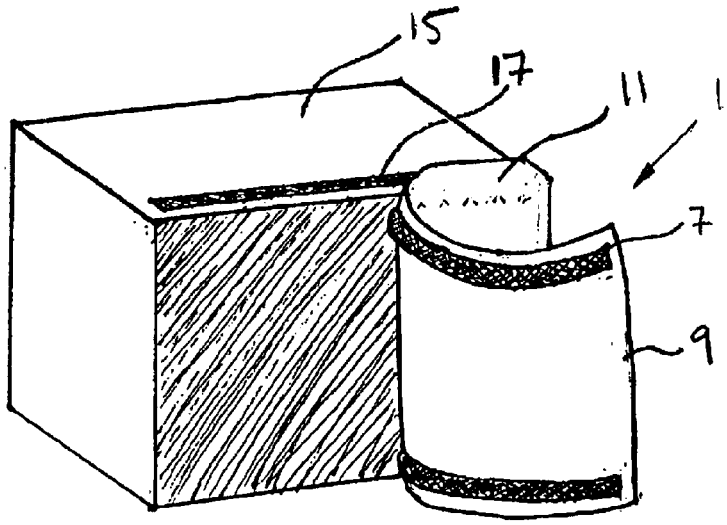
FIG. 4. Shows the beginning of the application of the pad to the musical equipment, with the hook and loop attachment partially applied to the top.
Figure 5:
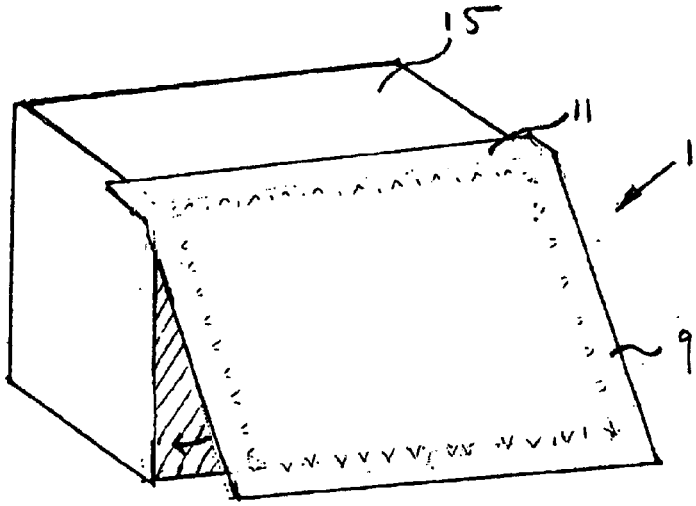
FIG. 5. Shows the top of the MusiCoveralls attached, ready to attach the rest of it.
Figure 6:
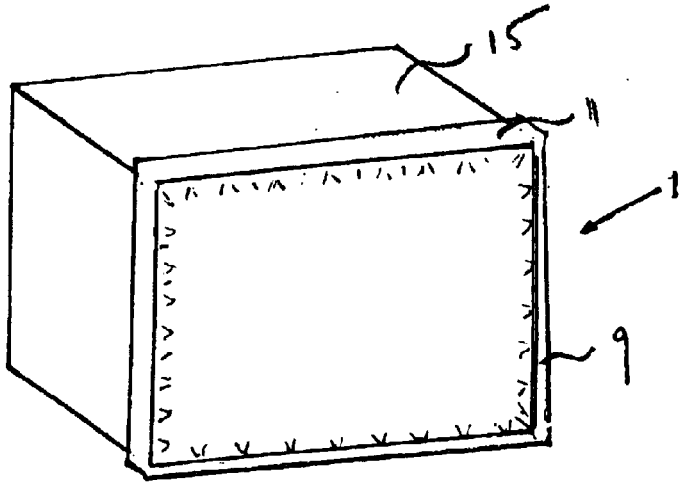
FIG. 6. Shows the pad fully applied to the musical equipment.
Figure 7:
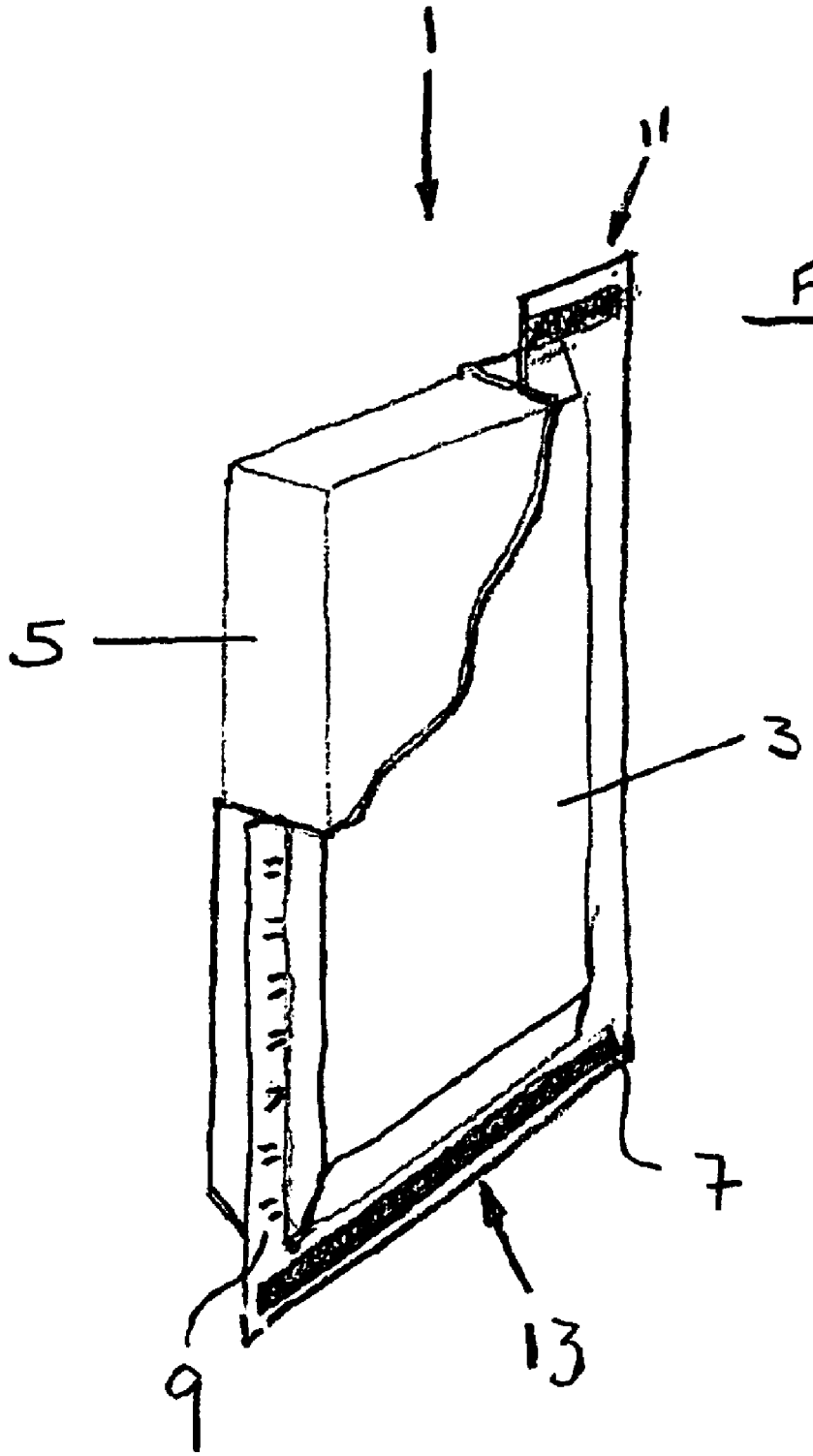
FIG. 7 is a perspective partially cut-away view of the pad illustrating the inner layer and the outer cover.

Referring to FIGS. 1–3, 7, the protective pad 1 is constructed by taking two pieces of durable, water-repellent material, the outer cover 3, and sewing a piece of resilient, flexible urethane foam, the inner layer 5 (FIG. 7) (approximately 1" to 2" thick) between the two pieces of material. The edges 9, 13 of the outer cover are sewn together and vinyl stripping may be added for durability. The top and bottom edges 13 of the pad have an additional 3" of fabric in order to attach the hook and loop strips 7. The hook and loop strips 7 correspond to hook and loop strips 17 which are adhered to the top and bottom of the music equipment 15 (FIGS. 4–6). When the hook and loop strips 7, 17 are aligned and attached together, it is form-fitting to the front, covering the knobs, screens, or fabric which might otherwise be damaged when left exposed. The size and material of the outside of the pad can be manufactured to adapt to the size of the musical equipment and the aesthetic desires of the consumer. Pockets can be sewn onto the pad as well, for cords or other small items to store. The protective pad may be removed and reattached from the music equipment at any time.

I claim the following:

1. A pad for protecting sound equipment such as speakers and amplifiers during storage and transportation comprising:

a padded flexible inner layer;

a flexible outer fabric cover which encloses said inner layer, said outer cover of a size such that said outer cover overlaps said inner layer forming edge portions;

a fastener attached to at least one of said edge portions for removably securing said pad to said musical sound equipment such that said pad may remain attached to an exterior surface of said musical sound equipment during transport of the equipment; said fastener allowing said pad to alternate between a first position in which the pad is deployed to protect the sound equipment during transport and a second position in which the pad remains attached to the sound equipment in a stored position while the sound equipment is in use.

2. The pad of claim 1 wherein two of the said edge portions contain fasteners.

3. The pad of claim 1 wherein said flexible outer cover is a water resistant fabric.

4. The pad of claim 1 wherein said flexible outer cover contains at least one pocket.

5. The pad of claim 1 wherein said inner layer is comprised of urethane foam.

6. A pad for protecting musical equipment during storage and transportation comprising:

a padded flexible inner layer manufactured from urethane foam;

a waterproof flexible outer cover which permanently encloses said inner layer, said outer cover of a size such that said outer cover overlaps said inner layer forming edge portions, two of said edge portions are larger than all other edge portions, the larger edge portions are located on opposite ends of the pad;

hook and loop fasteners attached to the two larger edge portions for securing said pad to said musical equipment;

at least one pocket on said flexible outer cover.

* * * * *